US006988506B1

(12) United States Patent
Apostolides

(10) Patent No.: US 6,988,506 B1
(45) Date of Patent: Jan. 24, 2006

(54) FLUID TRANSFER SYSTEM

(75) Inventor: John K. Apostolides, Pittsburgh, PA (US)

(73) Assignee: RPM Industries, Inc., Washington, PA (US)

( * ) Notice: Subject to any disclaimer, the term of this patent is extended or adjusted under 35 U.S.C. 154(b) by 345 days.

(21) Appl. No.: 10/347,958

(22) Filed: Jan. 21, 2003

Related U.S. Application Data

(63) Continuation of application No. 09/836,610, filed on Apr. 16, 2001, now Pat. No. 6,561,219, which is a continuation of application No. 09/435,375, filed on Nov. 5, 1999, now Pat. No. 6,216,732, which is a continuation-in-part of application No. 08/961,339, filed on Oct. 30, 1997, now abandoned.

(51) Int. Cl.
*F17D 1/18* (2006.01)
*E03B 5/00* (2006.01)

(52) U.S. Cl. ..... 137/13; 137/351; 137/560; 137/565.25; 184/1.5; 184/105.1

(58) Field of Classification Search ..... 137/560, 137/565.25, 351, 13; 184/1.5, 105.1
See application file for complete search history.

(56) References Cited

U.S. PATENT DOCUMENTS

| | | | | |
|---|---|---|---|---|
| 1,379,259 A | | 5/1921 | Hans | |
| 1,815,221 A | | 7/1931 | Sweetland | |
| 2,029,781 A | * | 2/1936 | McLean | 184/1.5 |
| 2,102,514 A | | 12/1937 | Clarkson | |

(Continued)

FOREIGN PATENT DOCUMENTS

| | | |
|---|---|---|
| DE | 197 43917 A1 | 4/1999 |
| EP | 0 416 688 A1 | 3/1991 |
| WO | WO 02/27186 A1 | 4/2002 |

OTHER PUBLICATIONS

International Search Report for International Application PCT/US 02/02415, Oct. 10, 2002.
U.S. Appl. No. 09/961,339, filed Oct. 30, 1997.
U.S. Appl. No. 10/612,205, filed Jul. 2, 2003.
U.S. Appl. No. 10/414,360, filed Apr. 15, 2003.
U.S. Appl. No. 10/253,950, filed Sep. 24, 2002.
Oil X–Changer Systems, www.x–change–r.com Internet Website, printed Feb. 18, 2003, 12 pages.
RPM Industries, Inc., Prelub The Simple Solution, tri–fold brochure, May 6, 1992, United States, 2 pages.
RPM Industries, Inc., "Prelub Plus Oil Evacuation System," dual sided brochure, Feb. 2, 1999, United States, 2 pages.
RPM Industries, Inc., "Prelub Plus—The engine–saving, money–saving, time–saving starter system," single page brochure, Jun. 22, 1999, United States, 1 page.
RPM Industries, Inc., "Prelub Plus [Protection from the start]," tri–fold brochure, Mar. 2, 1999, United States, 6 pages.

*Primary Examiner*—A. Michael Chambers
(74) *Attorney, Agent, or Firm*—Kirkpatrick & Lockhart Nicholson Graham LLP

(57) ABSTRACT

A portable fluid transfer conduit is disclosed having an elongated flexible conduit having an inlet and outlet port. A coupling is postured at the inlet port for receiving fluid from a fluid source such as prelubrication pump. A flow control member is located at the discharge end which includes an activator for controlling the flow of fluid. The flow control member may include a handheld pump where the fluid source does not have a powered flow.

34 Claims, 4 Drawing Sheets

U.S. PATENT DOCUMENTS 2,110,662 A 3/1938 Fisher
2,143,533 A 1/1939 Archea et al.
2,320,048 A 5/1943 Parson
2,603,312 A * 7/1952 Tabet ..... 184/1.5
2,838,039 A 6/1958 Smith et al.
2,887,058 A 5/1959 Aspelin et al.
2,928,499 A 3/1960 Nallinger
3,045,420 A 7/1962 Addie et al.
3,057,436 A 10/1962 Jacobson et al.
3,146,720 A 9/1964 Henry
3,282,380 A 11/1966 Burrell et al.
3,430,730 A 3/1969 Kitajima
3,503,412 A 3/1970 Schuler
3,583,525 A 6/1971 Holcomb
3,583,527 A 6/1971 Raichel
3,658,153 A 4/1972 Berman
3,722,623 A 3/1973 Waldecker
3,802,564 A 4/1974 Turman
3,826,113 A 7/1974 Noraas et al.
3,858,686 A 1/1975 Luterick
3,917,027 A 11/1975 Hakanson et al.
4,014,794 A 3/1977 Lewis
4,058,981 A 11/1977 Henson
4,061,204 A 12/1977 Kautz, Jr.
4,094,293 A 6/1978 Evans
4,095,673 A 6/1978 Takeuchi
4,112,910 A 9/1978 Percy
4,126,997 A 11/1978 Henson
4,157,744 A 6/1979 Capriotti
4,168,693 A 9/1979 Harrison
4,174,699 A 11/1979 Gill
4,199,950 A 4/1980 Hakanson et al.
4,240,523 A 12/1980 Nestor et al.
4,290,739 A 9/1981 Korse
4,331,112 A 5/1982 Pluequet
4,354,574 A 10/1982 Kieber
4,378,675 A 4/1983 Otto
4,402,287 A 9/1983 Cochran
4,421,078 A 12/1983 Hurner
4,458,644 A 7/1984 Papst
4,462,350 A 7/1984 Kurata
4,502,431 A 3/1985 Lulich
4,502,451 A 3/1985 Duprez
4,512,298 A 4/1985 Hayashi
4,553,512 A 11/1985 Showman
4,628,877 A 12/1986 Sundles et al.
4,813,853 A 3/1989 Otto et al.
4,834,039 A 5/1989 Apostolides
4,875,551 A 10/1989 Lulich
4,893,598 A 1/1990 Stasiuk
4,965,549 A 10/1990 Koike
4,977,978 A * 12/1990 Batrice ..... 184/1.5
5,014,820 A 5/1991 Evans
5,048,578 A 9/1991 Dorf et al.
5,056,621 A 10/1991 Trevino
5,168,845 A 12/1992 Peaker
5,195,476 A 3/1993 Schwarz
5,198,698 A 3/1993 Paul et al.
5,203,429 A 4/1993 Zager
5,236,064 A 8/1993 Wagoner
5,244,367 A 9/1993 Aslin
5,257,678 A * 11/1993 Stokes ..... 184/1.5
5,263,445 A 11/1993 Bedi et al.
5,327,862 A 7/1994 Bedi
5,353,760 A 10/1994 Zager
5,390,762 A 2/1995 Nelson
5,431,138 A 7/1995 Hurner
5,443,138 A 8/1995 Bedi et al.
5,452,695 A 9/1995 Bedi
5,462,420 A 10/1995 Stehr et al.
5,511,522 A 4/1996 Tran
5,526,782 A * 6/1996 Bedi et al. ..... 123/196 A
5,566,781 A 10/1996 Robert et al.
5,699,764 A 12/1997 Allen et al.
5,743,231 A 4/1998 Reinosa
5,748,500 A 5/1998 Quentin et al.
5,759,013 A 6/1998 Miyazaki et al.
5,797,732 A 8/1998 Watanabe et al.
5,823,750 A 10/1998 Hoffmann et al.
5,894,825 A 4/1999 Duerr
5,957,240 A 9/1999 Apostolides
5,964,256 A 10/1999 Bedi et al.
6,215,728 B1 4/2001 Yamada
6,216,732 B1 4/2001 Apostolides
6,461,118 B1 10/2002 Apostolides et al.
6,542,851 B2 4/2003 Hasegawa et al.
6,544,008 B1 4/2003 Apostolides et al.
6,561,219 B1 5/2003 Apostolides
2003/0150256 A1 8/2003 Jakoby et al.
2003/0202887 A1 10/2003 Apostolides et al.

* cited by examiner

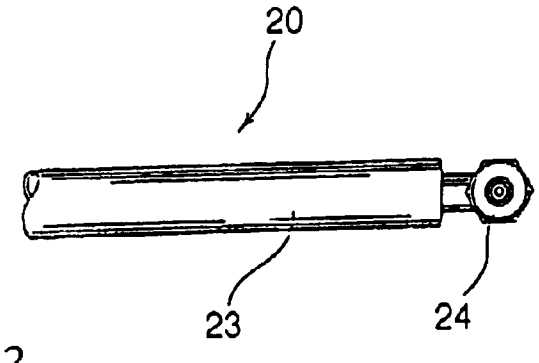
Fig. 3
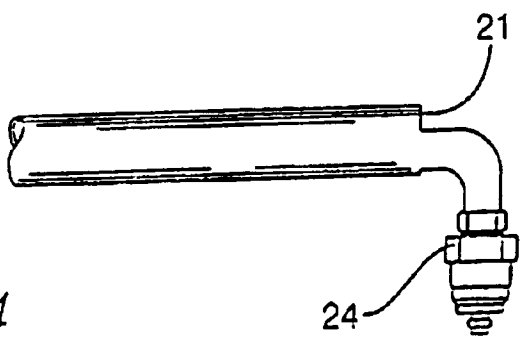
Fig. 4
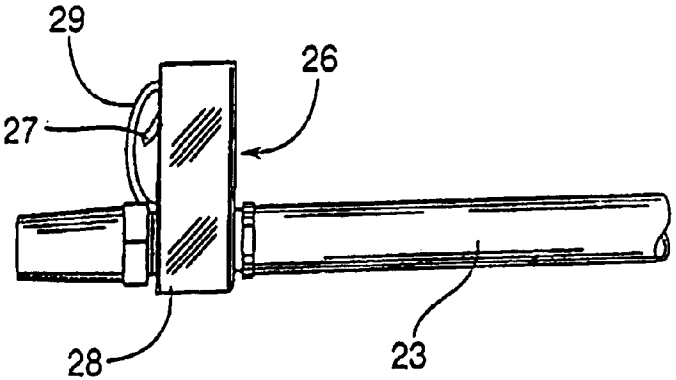
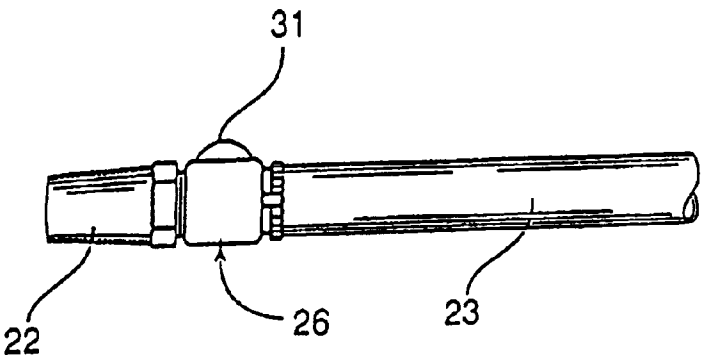

FLUID TRANSFER SYSTEM

CROSS REFERENCE TO RELATED APPLICATIONS

This application is a continuation of U.S. patent application Ser. No. 09/836,610, filed Apr. 16, 2001, now U.S. Pat. No. 6,561,219, issued Aug. 13, 2003, which is a continuation of U.S. patent application Ser. No. 09/435,375, filed Nov. 5, 1999, now U.S. Pat. No. 6,216,732, which is a continuation in part of U.S. patent application Ser. No. 08/961,339, filed Oct. 30, 1997, now abandoned.

FIELD OF INVENTION

The present invention relates to fluid transfer conduit having flow control means and an adapter means for connection with a source of fluid, and, in particular, to a portable fluid transfer conduit that is useful in the removal of fluids from equipment which do not have conveniently located outlet ports.

BACKGROUND OF THE INVENTION

Many industrial machines and equipment have requirements for fluid exchanges. Examples of these include changing the oil in motors and engines or hydraulic fluid in presses and lifting equipment. Countless other examples exist, but what is generally common to these machines or equipment is the fact that the outlet port is inconveniently located. Typically this is the result of having to remove the fluid from a sump or drainage point that is located at the bottom of the machine to utilize gravity flow.

While the task of removal is not difficult, it is often time consuming because of the inconvenient location of the fittings. However, in a number of the newer or retrofit machines, fluid circulation pumps are provided which are external to the machine or engine. Also, some of the newer equipment is fitted with external prelubrication devices which permit oil or fluid to commence circulation prior to the activation of the primary equipment or engine on which it is fitted. Illustrative of such devices is the prelubrication device shown in U.S. Pat. No. 4,502,431 which is incorporated herein by reference, which is typically fitted to a diesel engine used in power equipment, trucks or heavy equipment. Also, circulation devices used to heat hydraulic fluid are applicable to the present invention.

Additionally there are numerous smaller devices and motors where access to fluid discharge ports is difficult to reach or in which the fluid must be assisted for removal. Examples include marine engines and the like. In some small sized equipment, the engine must be inverted to remove the oil or other fluid. See also U.S. Pat. Nos. 5,526,782, 5,257,678 and 4,977,978.

Accordingly, it is an object of the invention to provide portable fluid transfer conduit that will facilitate the removal of fluids remote from the discharge port. It is also an object of the present invention to provide a conduit for use in fluid transfer that is adapted to fit a discharge port and remotely control the flow of fluid from an engine or equipment. Another object of the invention is to provide a portable transfer conduit that includes fluid pump means for extracting fluid from a machine or engine. A further object of the invention is adapter means for connecting the fluid transfer conduit to an outlet port for such fluid. Another object of the invention is an adapter connector for coupling an air evacuation means to purge or remove part of the fluid from the channels of the machine and filter.

SUMMARY OF THE PRESENT INVENTION

Generally, the present invention comprises a portable fluid transfer conduit having at least one flexible fluid conduit, Typically the conduit is made from a rubber or polymeric material, stainless steel braiding or the like. In most typical applications it comprises a polyethylene or propropylene tubing. The conduit includes an inlet port and an outlet port. The inlet port is adapted for connection with the discharge port of a fluid source such as the sump of an engine or a prelubrication pump. In one preferred embodiment of the invention, a coupler means is provided at the inlet port to couple the conduit with discharge port of the fluid source. Most preferably, a quick connect-disconnect fitting is secured to the inlet port of the conduit and a mateable fitting therewith at the discharge port.

A flow control means is positioned adjacent the outlet port of the conduit for controlling the flow of fluid from said source, such as a engine sump, through the conduit. In one preferred embodiment, the flow control means includes an actuator electrically connected to means for pumping the fluid from said fluid source, such as a prelubrication pump used in a diesel or internal combustion engine. In this embodiment, the flow control actuator includes disconnectable electrical connection means for control of the pump means.

In a second preferred embodiment, the flow control means comprises a pump for pumping the fluid from the fluid source through the conduit. The actuator includes electrical means such as a battery pack or connections to an external source of power such as an electrical wall outlet or battery on vehicle or equipment. The electrical connection is similar to the first embodiment in which disconnectable electric connectors are used. In the case of the battery pack or portable power source, the preferred pump is a light weight dc-motor driven pump in which a small light weight rechargeable battery pack is mounted as part of the flow control means.

In another embodiment in the invention, a quick connect conduit having a female coupling is used to connect an air gun or supply source of air pressure. The conduit includes a fitting in the line between the prelubrication pump and the system filter. This is preferably used prior to the removal of oil from the system to clear oil channels and at least some of the oil from the filter to simplify oil removal and make it safer for the workers.

While the present invention facilitates the removal of fluid from machines, engines, hydraulic systems and the like, other advantages of the invention will become apparent from a perusal of the following detailed description of presently preferred embodiments of the invention taken in connection with the accompanying drawings.

BRIEF DESCRIPTIONS OF THE DRAWINGS

FIG. 3 is a plan view of another embodiment of the invention having a pump integrally included in the flow control means;

FIG. 4 is a side elevation of the embodiment shown in FIG. 3; and

PRESENTLY PREFERRED EMBODIMENT

Figure 1:
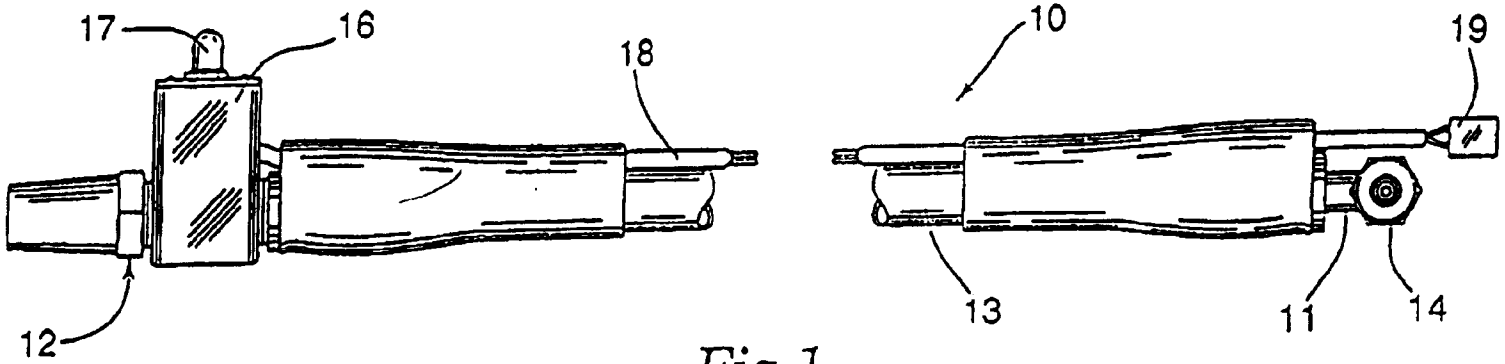
FIG. 1 is a side elevation of a presently preferred embodiment of the invention.
Figure 2:
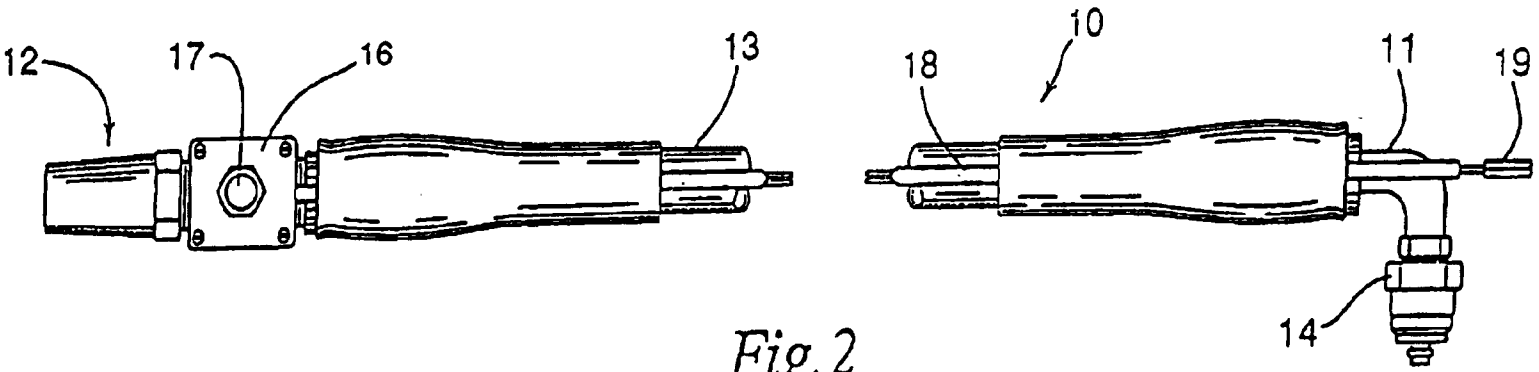
FIG. 2 is a plan view of the embodiment shown in FIG. 1 showing a quick connect coupling.

Referring to FIGS. 1 and 2, there is shown a portable fluid transfer conduit 10 having an inlet port 11 and outlet port 12. Flexibly extending between inlet and outlet ports 11 and 12 is flexible tubing 13. Tubing 13 is preferably made from a natural or synthetic rubber material, braided stainless steel or polymeric extruded material such as polyethylene or styrene.

Attached to inlet 11 is coupling 14. As shown, coupling 14 is the male mateable end of a quick disconnect coupling more clearly shown in FIGS. 5 and 6. Alternatively, coupling 14 can be any type of fitting such as a screw in or a bayonet type coupling. Preferably, however, a quick connect fitting is adapted to the outlet of the fluid source. On devices such as a prelubrication pump similar to that shown in U.S. Pat. No. 4,502,431, a bypass or connector means is easily inserted on the pressure side of the pump to divert the oil from the engine to the fluid transfer conduit 10. An example is disclosed relative to FIGS. 5 and 6 below.

Positioned adjacent outlet port 12 is flow control means 16. Flow control means comprises in one embodiment an electric or mechanical valve for controlling the flow of fluid through the conduit activated by switch 17. This embodiment is useful where the fluid source does not incorporate a pump means and/or the fluid is gravity transferred. On the other hand, in the case where means such as a prelubrication device is used, flow control means 16 is preferably a pass through conduit having switch 17 sealably mounted thereon. Switch 17 is electrically connected by conductor 18 to electrical connector 19 which is adapted to connect with the pump circuit to activate the pump and control the flow of fluid. Where flow control means 16 comprises an electric valve, conductor 18 and connector 19 are typically connected to a source of electrical power such as a battery terminal, a magnetic switch, relay contacts or other electromechanical means for activating the pumping means.

To drain a fluid such as oil or hydraulic oil from a piece of equipment is a simple matter of connecting coupling 14 to the outlet of the pump and initiating the pump through activation of flow control switch 17 or gravity flow. It should be noted that where a prelubrication pump is used, such as in U.S. Pat. No. 4,502,431 a valve is not required. The outlet port of fluid transfer conduit 10 is positioned at a remote and convenient location to discharge the fluid into a waste oil-receiving receptacle. Such waste oil-receiving receptacles are known in the art and may commonly comprise barrels or service vehicles adapted to receive and transport waste oil or other contaminated vehicle fluids.

Figure 5:
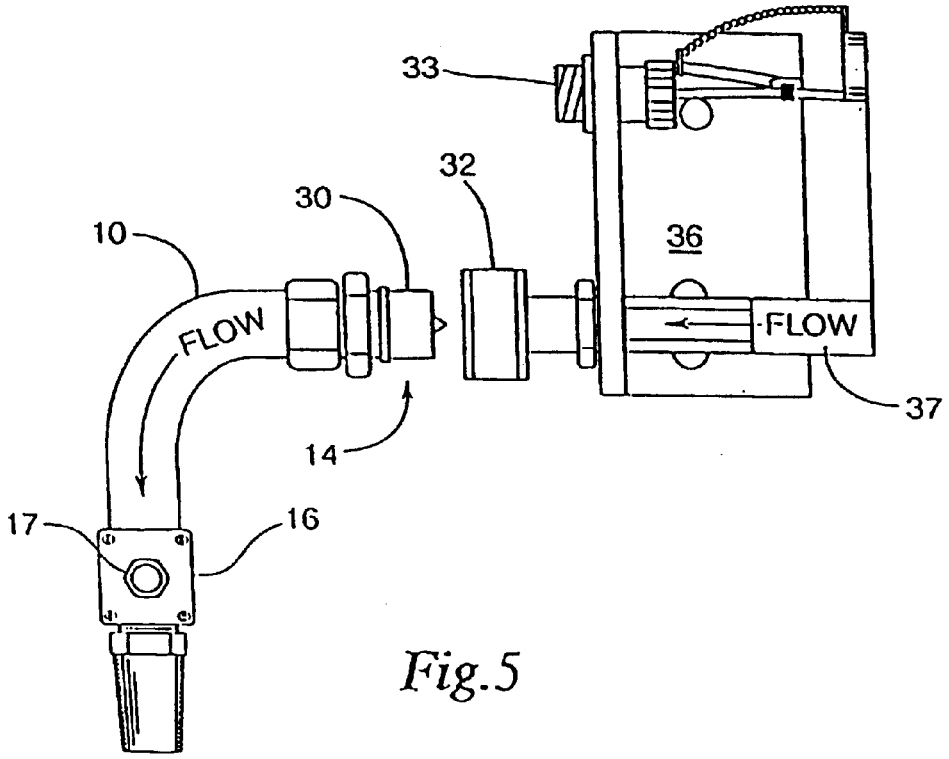
FIG. 5 and 6 are two views of a quick connect coupling for use with the present invention.
Figure 6:
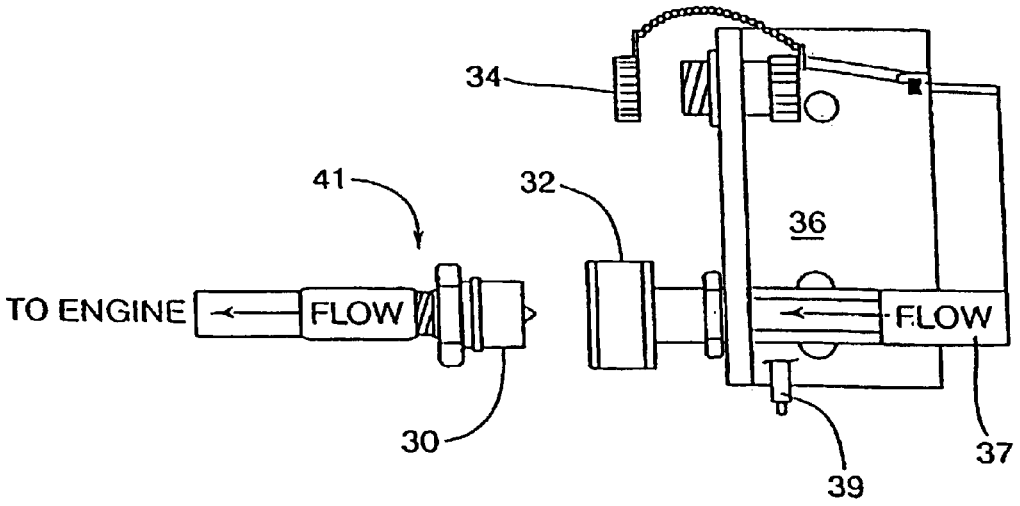

In another preferred embodiment shown in FIGS. 3 and 4, fluid transfer conduit 20 comprises a conduit 23 having an inlet port 21 and an outlet port 22. Inlet port 21 includes a coupling 24, preferably a mateable quick connect coupling as shown in FIGS. 5 and 6. In this embodiment, flow control means 16 comprises a small suction, diaphragm, piston or reciprocating pump 28 preferably including a battery pack within. Flow control means 16 includes activator switch 27 preferably in the form of a "trigger switch" having guard 29 and grip means 31 to facilitate holding the discharge end of fluid transfer conduit 20. It should be noted, however, that where a long transfer conduit is contemplated, for example 20 to 30 feet in length, it is desirable to locate the pump adjacent or in close proximity to coupling means 24.

Many types of small portable pumps 28 are commercially available on the market. A number of pumps are better suited for heavier or more viscose fluids but are not capable of being run with battery power. In such cases, a power cable such as conductor 18 and connector 19 can be used in this embodiment as well. Typically, the electrical power required can be supplied by a vehicle storage battery or an a-c pump can be connected to an a-c outlet.

The smaller pump means are especially useful in the consumer market and the larger pumps are specially applicable to the industrial market.

Referring to FIGS. 5 and 6 an example of a preferred coupling means 14 and 41 are respectively shown. Coupling means 14 and 41 are adaptable to both fluid transfer conduit embodiments shown with respect to FIGS. 1 and 3. Coupling 41 connects to the engine oil port (not shown) whereas coupling 14 is attached to conduit 10. Such couplings are well known in the art and comprise a male quick connector fitting 30 and a female mateable quick connector fitting 32. Also shown is an electrical receptor 33 for receiving electrical connector 19. It is also possible to include a sensing means on the coupling to indicate that the sump is dry and signal for shut down of the pump. A cap 34 is shown for protecting receptor 33 between periods of use. As shown in FIGS. 5 and 6, receptor 33 and fitting 32 are mounted on a bracket 36 which is then connected to a source of fluid 37, such as a prelubrication pump, not otherwise shown. In this embodiment, fitting 32 is connected in the output or high pressure side of the fluid source system. In the case of a prelubrication system, fitting 32 is interposed in the high pressure pump discharge line between pump and an engine.

As shown in FIG. 6 is a sampling port 39 can used to sample oil in a prelubrication system where the prelubrication pumps flows in to 37. This has the advantage of providing a live sample of oil without requiring the engine to be running.

Figure 7:
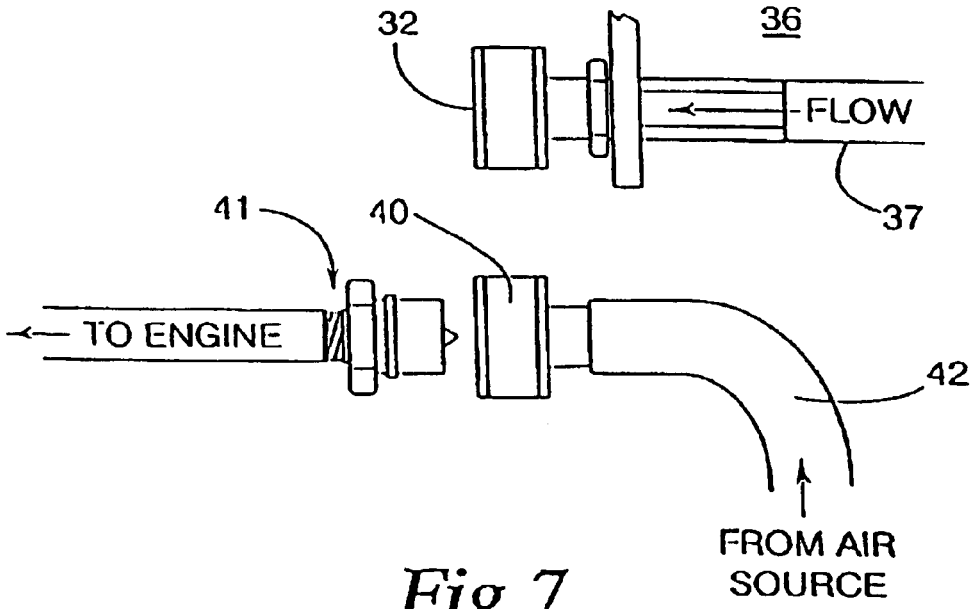
FIG. 7 is diagrammatic view of a conduit, a quick connect coupling for oil purges.

As shown in FIG. 7, an additional fitting 40 attached to air supply 42 is mounted on bracket 36. Preferably fitting 40 is quick connect female fitting adapted to a couple to air supply (not shown). By attaching an air source to fitting 40 prior to the removal of oil from the engine, oil resident in the channels can be removed to the sump and the oil in the filter system at least partially removed to facilitate removal of the filter, especially if it is hot. Typically, it is desirable to have the source of air at a pressure from about 90 to 150 Psi.

While presently preferred embodiments of the invention have been shown and described in particularity the invention may be otherwise embodied with in the scope of the appended claims.

What is claimed is:

1. A method of sampling a lubrication fluid from an engine lubrication system without operating the engine, the engine lubrication system having a supplemental pump that has a discharge port comprising:

activating the supplemental pump to pressurize the lubrication system without activating the engine; and removing a sample of lubrication fluid from a sampling port fluidically communicating with the discharge port of the supplemental pump.

2. A method of removing fluid from a fluid system within an engine and replacing the removed fluid with replacement fluid from a source of replacement fluid, the method comprising:

removably coupling an inlet end of a conduit to an engine port on the engine in communication with the fluid system, the conduit having an outlet end and a handheld pump integrally mounted to the conduit between the inlet end and outlet end; and actuating the pump to pump the fluid from the fluid system through the outlet end of the conduit.

3. The method of claim 2 further comprising detaching the conduit from the engine port after a desired amount of fluid has drained from the fluid system.

4. The method of claim 3 further comprising attaching a source of replacement fluid to the engine port and pumping a desired amount of replacement fluid from the source of replacement fluid into the fluid system through the engine port.

5. The method of claim 2 further comprising:

coupling a source of air pressure to the engine fluid system remote to said engine port prior to coupling the conduit to the engine port;

applying air pressure to the fluid system;

disconnecting the source of air pressure from the engine port; and coupling the conduit to the engine port.

6. A method of sampling a lubrication fluid from an engine lubrication system without operating the engine, the engine lubrication system having a prelubrication pump that has a discharge port comprising:

activating the prelubrication pump to pressurize the lubrication system without activating the engine; and removing a sample of lubrication fluid from a sampling port fluidically communicating with the discharge ed port of the prelubrication pump.

7. A method of replacing fluid in a fluid system within a vehicle engine in a vehicle that has a supplemental pump on the engine or vehicle that is operably connected to the fluid system, said method comprising:

providing a quick connect coupling having a first quick connect coupling portion in fluid communication with the fluid system and a second quick connect coupling portion in fluid communication with the discharge of the supplemental pump;

attaching a conduit to the second quick connect coupling portion;

activating the supplemental pump to pump fluid from the fluid system through the second quick connect coupling portion and through the conduit wherein it discharges therefrom;

deactivating the supplemental pump;

detaching the conduit from the second quick connect coupling portion;

admitting replacement fluid from a source of replacement fluid through the first quick connect coupling portion and into the fluid system;

disconnecting the source of replacement fluid; and connecting the first quick connect coupling portion to the second quick connect coupling portion.

8. A fluid transfer apparatus for removing fluid from a fluid reservoir on a vehicle, said apparatus comprising:

a conduit having an inlet end and an outlet end;

an inlet coupler attached to said inlet end and removably attachable to a port in communication with the fluid reservoir;

a supplemental handheld pump fluidically coupled to said conduit; and pump controller communicating with said supplemental pump for selective activation thereof such that when said supplemental pump is activated, fluid flows from the fluid reservoir on the vehicle and through said conduit to said outlet end of said conduit when said coupler is attached in fluidic communication with said port.

9. The apparatus of claim 8 further comprising a nozzle affixed to said outlet end of said conduit.

10. The apparatus of claim 8 wherein said outlet end discharges into a waste oil-receiving receptacle.

11. The apparatus of claim 8 wherein said pump has a self-contained battery for supplying power thereto.

12. The apparatus of claim 8 wherein said inlet coupler comprises a quick disconnect fitting.

13. The apparatus of claim 8 wherein said pump controller comprises a trigger switch assembly coupled to said conduit and electronically connected to said supplemental pump, said trigger switch assembly mounted adjacent to said outlet end to facilitate manual support and manipulation of said outlet end.

14. The apparatus of claim 13 wherein said trigger switch assembly comprises:

a guard; and a grip means attached to the guard.

15. The apparatus of claim 8 wherein said conduit is up to 30 feet long and wherein said pump is located adjacent to said inlet end thereof.

16. The apparatus of claim 8 wherein said pump is powered by alternating current supplied from a remote source of alternating current through a conductor attached therebetween.

17. The apparatus of claim 8 further comprising a fluid sensor coupled to said inlet coupler and said pump.

18. The apparatus of claim 8 wherein said inlet coupler comprises a valve.

19. A fluid transfer apparatus for use in connection with a vehicle having an engine with an oil reservoir, comprising:

a prelubrication pump supported on the engine or vehicle and being fluidically connected to said oil reservoir, and having an outlet;

at least one portable conduit having an inlet port connectable to said outlet and an outlet port; and a pump controller operably connected to said prelubrication pump for selective activation thereof such that when said pump is activated fluid flows from the oil reservoir for the vehicle and through said conduit to said outlet port when said inlet port is attached in fluidic communication with said outlet of said prelubrication pump.

20. A fluid transfer apparatus for use in connection with engine powered equipment having a hydraulic fluid reservoir, comprising:

a prelubrication pump supported on the engine powered equipment and being fluidically connected to said hydraulic fluid reservoir, and having an outlet;

at least one portable conduit having an inlet port and an outlet port;

a coupler at said inlet port and connectable to said outlet; and a pump controller operably connected to said prelubrication pump for selective activation thereof such that when said pump is activated fluid flows from the hydraulic fluid reservoir for the engine powered equipment and through said conduit to said outlet port when said coupler is attached in fluidic communication with said outlet of said prelubrication pump.

21. A fluid transfer apparatus for use in connection with engine powered equipment having a hydraulic fluid reservoir, comprising:

a prelubrication pump supported on the engine powered equipment and being fluidically connected to said hydraulic fluid reservoir, and having an outlet;

at least one portable conduit having an inlet port connectable to said outlet, and an outlet port; and a pump controller operably connected to said prelubrication pump for selective activation thereof such that when said pump is activated, fluid flows from the hydraulic fluid reservoir for the engine powered equipment and through said conduit to said outlet port when said coupler is attached in fluidic communication with said prelubrication pump.

22. A fluid transfer system for removing fluids from at least one fluid reservoir on an engine powered apparatus, the system comprising:

a prelubrication pump fluidically connected to said at least one fluid reservoir, and having an outlet;

at least one portable conduit having an inlet port connectable to the outlet, and an outlet port; and a pump controller operably connected to the prelubrication pump for selective activation thereof such that when said pump is activated, fluid flows from sad at least one fluid reservoir for the apparatus and through said conduit to said outlet port when said inlet port is attached in fluidic communication with said outlet of said prelubrication pump.

23. A fluid transfer system for removing fluids from at least one fluid reservoir on an engine powered apparatus, the system comprising:

a pump supported on said engine powered apparatus and fluidically connected to said at least one fluid reservoir, and having an outlet;

at least one portable conduit having an inlet port fluidically connectable to the outlet, and an outlet port; and a pump controller operably connected to said pump such that when said pump is activated, fluid flows from said at least one fluid reservoir on the apparatus and through said conduit to said outlet port when said conduit is in fluidic communication with said pump.

24. Fluid changing apparatus for an engine having a fluid system, said fluid changing apparatus comprising:

a conduit having an outlet end and an inlet end;

a first quick disconnect portion fluidically coupled to said inlet end of said conduit;

a third quick disconnect portion fluidically coupled to the engine and which communicates with the fluid system;

a second quick disconnect portion fluidically coupled to a discharge port of a pump arranged to pump a fluid to said fluid system, said second quick disconnect portion adapted to be removably fluidically coupled to said third quick disconnect portion during normal operation of the engine, or to said first quick disconnect portion to remove fluid from said fluid system; and a flow controller operatively communicating with said pump for selective activation thereof such that when said pump is activated, fluid flows from the fluid system for the engine and through said conduit to said outlet port when said first quick disconnect portion is attached in fluidic communication with said second quick disconnect portion.

25. The apparatus of claim 24 wherein said conduit is portable.

26. A fluid, transfer system for use in connection with a vehicle engine having a supplemental pump supported on the engine or vehicle and operably connected to a fluid reservoir for the engine, said fluid transfer system comprising:

A. at least one portable conduit having an inlet and outlet port;

B. coupler at said inlet port for fluidically coupling said fluid conduit to the supplemental pump; and C. pump controller communicating with the supplemental pump for selective activation thereof such that when the pump is activated, fluid flows from the fluid reservoir for the engine and through said conduit to said outlet port when said coupler is attached in fluidic communication with the supplemental pump.

27. A fluid transfer system for use in connection with an engine powered apparatus having a pump supported on the apparatus and operably connected to a fluid reservoir for the apparatus, said fluid transfer system comprising:

A. at least one portable conduit having an inlet and outlet port;

B. coupler at said inlet port for fluidically coupling said fluid conduit to the pump; and C. pump controller communicating with the pump supported on the engine powered apparatus for selective activation thereof such that when the pump is activated, fluid flows from the fluid reservoir for the apparatus and through said conduit to said outlet port when said coupler is attached in fluidic communication with the pump.

28. A fluid transfer system for removing fluid from a fluid reservoir on an engine powered apparatus, the system comprising:

a pump mounted on the engine powered apparatus and fluidically connected to said reservoir, and having an outlet;

at least one portable conduit having an inlet port fluidically connectable to the outlet, and an outlet port; and a pump controller operably connected to the pump for selective activation thereof such that when said pump is activated, fluid flows from the fluid reservoir for the apparatus and through said conduit to said outlet port when said inlet port is attached in fluidic communication with said outlet of said pump.

29. Fluid changing apparatus for an engine having a fluid system, said fluid changing apparatus comprising:

a portable conduit having an outlet end and an inlet end;

a first quick disconnect portion fluidically coupled to said inlet end of said portable conduit;

a mounting bracket supporting a second quick disconnect portion fluidically coupled to a discharge port of a pump mounted adjacent to said engine and arranged to pump a fluid from said fluid system, said second quick disconnect portion adapted to be removably fluidically coupled to said first quick disconnect portion to remove fluid from said fluid system; and a flow controller operatively connected to said pump for selective activation thereof such that when said pump is activated, fluid flows from said fluid system and through said outlet end when said first quick disconnect portion is fluidically coupled to said second quick disconnect portion.

30. The apparatus of claim 29 wherein said flow controller is mounted on said bracket.

31. The apparatus of claim 29 wherein said flow controller is mounted on said conduit.

32. Fluid changing apparatus for an engine powered apparatus having a fluid system, said fluid changing apparatus comprising:

a portable conduit having an outlet end and an inlet end;

a first quick disconnect portion fluidically coupled to said inlet end of said portable conduit;

a mounting bracket supporting a coupler fluidically coupled to a discharge port of a pump mounted adjacent to said engine powered apparatus and arranged to pump a fluid from said fluid system, said coupler adapted to be removably fluidically coupled to said inlet end to remove fluid from said fluid system; and a flow controller operatively connected to said pump for selective activation thereof such that when said pump is activated, fluid flows from said fluid system and through said outlet end when said first quick disconnect portion is fluidically coupled to said second disconnect portion.

33. The apparatus of claim 32 wherein said flow controller is mounted on said bracket.

34. The apparatus of claim 32 wherein said flow controller is mounted on said conduit.

* * * * *

UNITED STATES PATENT AND TRADEMARK OFFICE

CERTIFICATE OF CORRECTION

PATENT NO. : 6,988,506 B1
APPLICATION NO. : 10/347958
DATED : January 24, 2006
INVENTOR(S) : John K. Apostolides It is certified that error appears in the above-identified patent and that said Letters Patent is hereby corrected as shown below:

Title page, under item [56], Column 2,

Other Publications, delete "09/961,339" and replace therewith --08/961,339--.

Column 2, line 14, delete "inlet port" and replace therewith --outlet port--.

Column 2, line 18, delete "a engine" and replace therewith --an engine--.

Column 4, line 28, delete "can used" and replace therewith --can be used--.

Column 4, line 30, delete "pumps flows" and replace therewith --pump flows--.

Signed and Sealed this

Twenty-fourth Day of April, 2007

JON W. DUDAS
*Director of the United States Patent and Trademark Office*